US007600882B1

(12) United States Patent
Morejon et al.

(10) Patent No.: US 7,600,882 B1
(45) Date of Patent: Oct. 13, 2009

(54) HIGH EFFICIENCY INCANDESCENT BULB REPLACEMENT LAMP

(75) Inventors: Israel J. Morejon, Tampa, FL (US); Jinhui Zhai, Oldsmar, FL (US); Thong Bui, Tarpon Springs, FL (US)

(73) Assignee: LEDnovation, Inc., Tampa, FL (US)

( * ) Notice: Subject to any disclaimer, the term of this patent is extended or adjusted under 35 U.S.C. 154(b) by 0 days.

(21) Appl. No.: 12/356,206

(22) Filed: Jan. 20, 2009

(51) Int. Cl.
*F21V 9/16* (2006.01)

(52) U.S. Cl. ..... 362/84; 362/249.02; 362/249.14; 362/231; 362/240; 362/249.06

(58) Field of Classification Search ..... 362/231, 362/249.02, 249.14, 249.06, 235, 240, 245, 362/247, 84, 307, 308, 310; 313/498, 502–504, 313/512; 257/98
See application file for complete search history.

(56) References Cited

U.S. PATENT DOCUMENTS

| | | | | |
|---|---|---|---|---|
| 6,157,126 | A | 12/2000 | Yano et al. | |
| 6,586,882 | B1 * | 7/2003 | Harbers | 313/634 |
| 6,814,470 | B2 | 11/2004 | Rizkin et al. | |
| 6,948,829 | B2 | 9/2005 | Verdes et al. | |
| 6,995,355 | B2 * | 2/2006 | Rains et al. | 250/228 |
| 7,061,454 | B2 | 6/2006 | Sasuga et al. | |
| 7,144,131 | B2 * | 12/2006 | Rains | 362/231 |
| 7,145,125 | B2 * | 12/2006 | May et al. | 250/228 |
| 7,178,941 | B2 | 2/2007 | Roberge et al. | |
| 7,213,940 | B1 | 5/2007 | Van De Ven et al. | |
| 7,318,659 | B2 * | 1/2008 | Demarest et al. | 362/253 |
| 7,350,936 | B2 | 4/2008 | Ducharme et al. | |
| 7,358,679 | B2 | 4/2008 | Lys et al. | |
| 7,387,405 | B2 | 6/2008 | Ducharme et al. | |
| 7,390,106 | B2 | 6/2008 | Walton | |
| 7,390,684 | B2 | 6/2008 | Izuno et al. | |
| 2007/0235639 | A1 * | 10/2007 | Rains, Jr. | 250/228 |
| 2007/0267976 | A1 * | 11/2007 | Bohler et al. | 315/112 |
| 2008/0170392 | A1 | 7/2008 | Speier et al. | |

* cited by examiner

*Primary Examiner*—Thomas M Sember
(74) *Attorney, Agent, or Firm*—Harvey S. Kauget; Phelps Dunbar LLP

(57) ABSTRACT

The invention discloses a high efficiency incandescent and Compact Fluorescent (CFL) bulb replacement LED lamp having a good color reproduction. The LED light bulb includes two groups of semiconductor light emitters and a luminescent material to emit four different spectrums of light. The two groups of semiconductor light emitters are enclosed around an interior wall of the light bulb housing, which has a plurality of fins at an exterior surface for effective heat dissipation. A high reflective member having a dome shape in the center is disposed under the two groups of semiconductor light emitters to redirect the emission and excitation lights from the two groups of semiconductor light emitters and recycle the backscattered light for multi-spectrum light mixing. The LED-light bulb further includes a single power line connecting to the two groups of semiconductor light emitters and a high efficiency electrical AC/DC conversion and control device. The light bulb has a diffuser dome for an output window and a conventional Edison-mount screw-type light bulb socket, a conventional fluorescent tube coupler arrangement or a conventional halogen MR-16 socket arrangement connecting to an AC power base. If a voltage is supplied to the AC/DC conversion and control device, a mixture light from the diffuser dome produces a warm white light with a color rendering index of at least 85 and a luminous efficacy of at least 80 lumens per watt.

24 Claims, 3 Drawing Sheets

HIGH EFFICIENCY INCANDESCENT BULB REPLACEMENT LAMP

FIELD OF INVENTION

The invention relates generally to an incandescent bulb replacement lamp, as well as related components, systems and methods, and more particularly to methods to make a warm white light bulb with a high color rendering and a high luminous efficacy.

BACKGROUND OF THE INVENTION

It is well known that incandescent light bulbs are a very energy inefficient light source—about 90% of the electricity they consume is released as heat rather than light. Fluorescent light bulbs are by a factor of about 10 more efficient, but are still less efficient than a solid state semiconductor emitter, such as light emitting diodes, by a factor of about 2.

In addition, incandescent light bulbs have a relatively short lifetime, i.e., typically about 750-1000 hours. Fluorescent bulbs have a longer lifetime (e.g., 10,000 to 20,000 hours) than incandescent lights, but they contain mercury, not an environment friendly light source, and they provide a less favorable color reproduction. In comparison, light emitting diodes have a much longer lifetime (e.g., 50,000 to 75,000 hours). Furthermore, solid state light emitters are a very clean "green" light source and can achieve a very good color reproduction.

Accordingly, for these and other reasons, efforts have been ongoing to develop solid state light devices to replace incandescent light bulbs, fluorescent lights and other light-generating devices in a wide variety of applications. In addition, where light emitting diodes (or other solid state light emitters) are already being used, efforts are ongoing to provide improvement with respect to energy efficiency, color rendering index (CRI Ra), luminous efficacy (lm/W), color temperature, and/or duration of service, especially for indoor applications.

A semiconductor light emitting device utilizes a blue light emitting diode having a main emission peak in the blue wavelength range from about 400 nm to 490 nm and a luminescent layer containing an inorganic phosphor that absorbs the blue light emitted by the blue LED and produces an excited light having an emission peak in a visible wavelength range from green to yellow (in the range of about 530 nm to 580 nm) having a spectrum bandwidth (full width of half maximum, simply refer to FWHM) of about 80 nm to 100 nm.

Almost all the known light emitting semiconductor devices utilizing blue LEDs and phosphors in combination to obtain color-mixed light of the emission light from the blue LEDs and excitation light from the phosphors use a YAG-based or silicate-based luminescent layer as phosphors. These solid state light devices have typically a white color temperature of about 5000 K to 8500 K with a low color rending index Ra of about 60~70. This type of white solid state light device is not desirable for some applications, like indoor applications, which require a warm white color temperature of about 2700 K to 3500 K with a high color rending index Ra above 80.

A conventional solid state warm white light device is realized by adding orange or red phosphors into yellow or green phosphors to adjust the color temperature to less than about 3500 K and improve the color rendering index. However, there are low luminous efficacy issues caused by: a) multi-phosphors self-absorption loss of the photons excited from the green and orange phosphor particles; and b) Stoked-shift loss from blue-to-red wavelength conversion.

Thus, there remains a need for an improved warm white solid state light device that overcomes mixed-multi-phosphors self absorption loss and Stoked-shift loss from blue-to-red wavelength conversion.

There is also a need to further improve luminous efficacy in order to produce higher electrical-to-optical energy conversion efficiency with a good thermal dissipation design for a compact incandescent bulb replacement device and compete with fluorescent bulbs for high volume and cost effective commercial and residential applications.

There is also a need to improve color mixing uniformity from multi-colors semiconductor light emitting device in order to produce a color uniform light from a solid state lighting device for lighting applications.

However, in view of the prior art taken as a whole at the time the present invention was made, it was not obvious to those of ordinary skill how the identified need could be fulfilled.

BRIEF SUMMARY OF THE INVENTION

The long-standing, but heretofore unfulfilled, need for an apparatus and method for a high luminous efficacy incandescent bulb replacement semiconductor lamp that overcomes mixed-multi-phosphors self absorption loss and Stoked-shift loss, and non-radiative energy heat dissipation challenge is now met by a new, useful, and non-obvious invention.

In general, the present invention provides an incandescent and/or compact fluorescent replacement LED bulb including a plurality of semiconductor light devices mounted around the interior annular side wall of the light bulb's thermal conductive body inside a light mixing cavity. The plurality of semiconductor light devices includes two groups of semiconductor light emitters and a luminescent material that emit four different hues of light. The first group of semiconductor light emitters produce a mixture of white light from an emitted primary light and an excited second long wavelength light. A second luminescent material may be added on top of the first luminescent material to absorb a leaked primary first light and to excite a third light. The second group of semiconductor light emitters produce an emitted fourth light in the red spectrum range. The light mixing cavity inside the incandescent replacement bulb comprises a diffusive light output window, a high reflective member with a convex shape in the center disposed under the two groups of semiconductor light emitters to redirect the emission and excitation lights from the two groups of semiconductor light emitters; and a reflective member disposed inside of the interior wall surrounding the two groups of semiconductor light emitters.

The light bulb further includes a single power line connected to the two groups of semiconductor light emitters and a high efficiency electrical AC/DC conversion and control device with a high power factor.

The light bulb further includes a conventional Edison-mount socket connecting to an AC power base.

If a voltage is supplied to the electrical conversion device, a mixture of light from the emitted and the excited four spectrums of light produce a warm white light with a color rendering index of at least 85 and a luminous efficacy of at least 80 lumens per watt.

In one embodiment according to the present invention, a first group of semiconductor light emitters produce a blue light. A first luminescent yellow phosphor layer is deposited on top of the first group of semiconductor light emitters to absorb the blue light and excite a yellow light. A second luminescent green phosphor layer can be disposed on top of the first luminescent layer to cover at least a portion of the first luminescent layer, which absorbs leaked blue light from the first luminescent layer and excites a green light to compensate for the shortage of bluish green spectrum in the excited yellow light. The second group of semiconductor light emitters emit a reddish orange light to compensate for the shortage of red spectrum in the excited yellow light. The leaked blue light, the excited yellow light, the emitted reddish orange light and the excited green light are thoroughly mixed in the light mixing cavity. The mixture light from the diffusive output window produces a warm white light with a color rendering index of at least 85 and a luminous efficacy of at least 80 lumens per watt.

In another embodiment according to the present invention, a first group of semiconductor light emitters produce a blue light. A first luminescent yellow phosphor layer is deposited on top of the first group of semiconductor light emitters to absorb a portion of the blue light and excite a yellow light. A second luminescent green phosphor layer can be disposed on top of the first luminescent layer to cover at least a portion of the first luminescent layer, which absorbs leaked blue light from the first luminescent layer, excites a green light to compensate for the shortage of bluish green spectrum in the excited yellow light and excites a reddish orange light to compensate for the shortage of red spectrum in the excited yellow light. The leaked blue light, the excited yellow light, the excited reddish orange light and the excited green light are thoroughly mixed in the light mixing cavity. The mixture light from the diffusive output window produces a warm white light with a color rendering index of at least 85 and a luminous efficacy of at least 80 lumens per watt.

In another embodiment according to the present invention, the first group of semiconductor light emitters produces a mixture light of blue light and excited yellow light. The second group of semiconductor light emitters emit a reddish orange light to compensate for the shortage of red spectrum in the excited yellow light. A second luminescent green phosphor layer can be disposed on top of a high reflective member inside the light mixing cavity to absorb leaked blue light from the first luminescent layer and excite a green light to compensate for the shortage of bluish green spectrum in the excited yellow light. A dome shaped lens or luminescent material may encapsulate the semiconductor light emitters. The diffusive output window may have a dome shape. The leaked blue light, the excited yellow light, the emitted reddish orange light and the excited green light are thoroughly mixed in the light mixing cavity. The mixture light from the dome shaped diffuser produces a warm white light with a color rendering index of at least 85 and a luminous efficacy of at least 80 lumens per watt.

In an additional embodiment according to the present invention, a high reflective member inside the light mixing cavity under the two groups of semiconductor light emitters includes a diffusive reflection dome in the center to randomly redirect the emission and excitation lights from the semiconductor light emitters into the light mixing cavity. Some of the emitted and/or excited light from the semiconductor light emitters is directly forward propagated into the light mixing cavity. Some of the emitted and/or excited light from the semiconductor light emitters is randomly redirected by the center diffusive reflection dome into the light mixing cavity and thoroughly mix with the directly forward propagated light from the other semiconductor light emitters.

In some embodiments according to the present invention, two groups of semiconductor light emitters are mounted around the interior sidewall of the light bulb thermal conductive housing with a plurality of fins at an exterior surface for effective heat dissipation. When a current is applied to a semiconductor light emitting device, some of the injected electrons and holes in the semiconductor material are recombined and submit radiative photons which are extracted from the semiconductor light emitting device; but some of uncombined electrons/holes, non-radiative combinations and trapped photons become heat and need to be effectively dissipated for high electrical-to-optical conversion efficiency. With semiconductor light emitters mounted around the interior wall surface of the high thermal dissipation light bulb housing and a plurality of fins built directly at the exterior wall surface in proximity to the semiconductor light emitters, a very short thermal dissipation path is formed for effective heat dissipation from the semiconductor lighting device to the thin light bulb housing wall, to the plurality of fins, and to the air.

In an additional embodiment according to the present invention, the high efficiency electrical AC/DC conversion member converts at least 90% of AC power from an Edison mount socket into a DC driving current to inject high efficiency DC current into the LED board with a high power factor. A single chip based controller in a close loop Pulse Width Current Modulator drives a single high side Field Effect Transistor (FET). The FET is driven with an internal ramp compensation and built in frequency jittering for low electromagnetic interference. With the controller internal operating frequency set, the device supplies itself from the high voltage rail with the voltage required to drive the FET and in doing so avoids a transformer auxiliary winding. This design feature allows a driver without a bulky transformer which is a very desirable condition in the system of the present invention due to major space constraints. The current mode control also provides excellent pulse by pulse current control which allows for good load response variations. Additionally, the internal ramp compensation prevents sub-harmonic oscillations from taking place in continuous conduction mode operation. When the current set point falls below a given value, the output power demand diminishes; then the controller enters a skip cycle mode and provides excellent efficiency at light loads. This would be a requirement when dimming occurs at the bulb lever by the user. The driver design also provides efficient protective circuitry for over voltage and current conditions.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

DETAILED DESCRIPTION OF THE INVENTION

Figure 1:
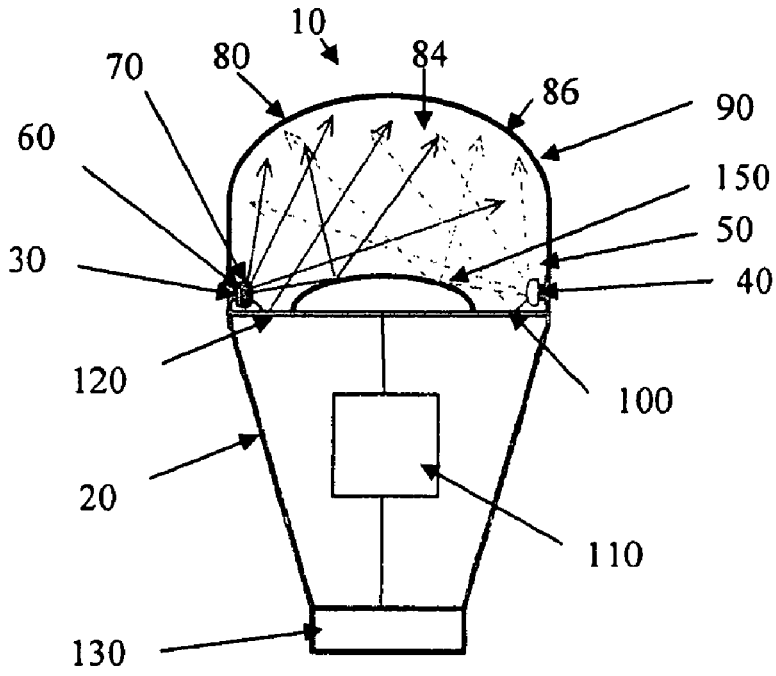
FIG. 1 is a cross sectional view of one embodiment of an LED-based light bulb according to the present invention.

As shown in FIG. 1, an LED-based light bulb 10 of the present invention comprising a plurality of semiconductor light devices that can be mounted radially around the interior annular side wall 50 of the light bulb's thermal conductive body 20 inside a light mixing cavity 80. The plurality of semiconductor light devices includes two groups of semiconductor light emitters that emit four different hues of light and a first luminescent material 60. The first group of semiconductor light emitters 30 produce a mixture of white light from an emitted primary hue of light and an excited second long wavelength hue of light. The second group of semiconductor light emitters 40 produce an emitted fourth hue of light in the red spectrum range.

In one embodiment, each light emitter of the first group of semiconductor light emitters 30 and the second group of semiconductor light emitters 40 can be circumferentially spaced apart from one another about a periphery of the interior annular sidewall 50 of the thermal conductive light bulb housing body 20. In addition, each light emitter of the first group of semiconductor light emitters 30 and the second group of semiconductor light emitters 40 can be multi-spectrums intervallically and equidistantly spaced apart from one another about a periphery of the annular sidewall 50 of the thermal conductive light bulb housing body 20.

In another embodiment, a second luminescent material 70 can be disposed on top of the first luminescent material 60 to absorb leaked primary hue of light and excite a third hue of light. Optionally, a transparent resin layer can be applied between the first luminescent material 60 and the second luminescent material 70. Whereby, the combination of leaked primary hue of light, excited second long wavelength hue of light and excited third hue of light produce a fourth hue of light.

In another embodiment, the first group of semiconductor light emitters 30 emit a greenish yellow light and a blue light. The first luminescent material 60 absorbs at least a portion of the blue light and excites a yellow light. A second luminescent material 70 covering at least a portion of the first luminescent material 60 wherein the second luminescent material 70 absorbs leaked blue light from the first luminescent material 60 and excites a green light. Optionally, the second luminescent material 70 can have a dome shape. Whereby, the combination of leaked blue light, excited yellow light and excited green light produce a greenish yellow light. The greenish yellow light can have (x, y) coordinates (0.31, 0.41), (0.29, 0.51), (0.39, 0.47), and (0.38, 0.40) on a 1931 CIE Chromaticity Diagram within an area enclosed by four line segments.

The light mixing cavity 80 is positioned inside an upper portion 84 of the incandescent bulb's thermal conductive body 20. The light mixing cavity 80 comprises a diffusive light output window 90. In addition, interior wall 50 of the light mixing cavity 80 has a plurality of reflective surfaces 86 surrounding the plurality of semiconductor light emitters 30, 40. A reflective member 100 is positioned within the light mixing cavity 80. The reflective member 100 can have a convex shape in the center and is disposed under and in proximity to the plurality of semiconductor light emitters 30, 40 to redirect emission light and excitation light from the plurality of semiconductor light emitters 30, 40.

The LED-based light bulb 10 of the present invention further includes a single power line 120 connected to the plurality of semiconductor light emitters 30, 40 and a high efficiency electrical AC/DC conversion and control device 110 outside of the light mixing cavity 80. The LED-based light bulb 10 of the present invention further includes a conventional Edison-mount socket 130 connecting to an AC power base (not shown). Note, the present invention is designed to integrate with a conventional Edison-mount screw-type light bulb socket, a conventional fluorescent tube coupler arrangement and a conventional halogen MR-16 socket arrangement.

In an additional embodiment according to the present invention, the high efficiency electrical AC/DC conversion and control device 110 converts at least 90% of AC power from an Edison mount socket 130 into a DC driving current to inject high efficiency DC current into the LED board with a high power factor. A single chip based controller in a close loop Pulse Width Current Modulator drives a single high side Field Effect Transistor (FET). The FET is driven with an internal ramp compensation and built in frequency jittering for low electromagnetic interference. With the controller internal operating frequency set, the device supplies itself from the high voltage rail with the voltage required to drive the FET and in doing so avoids a transformer auxiliary winding. This design feature allows a driver without a bulky transformer which is a very desirable condition in the system of the present invention due to major space constraints. The current mode control also provides excellent pulse by pulse current control which allows for good load response variations. Additionally, the internal ramp compensation prevents sub-harmonic oscillations from taking place in continuous conduction mode operation. When the current set point falls below a given value, the output power demand diminishes; then the controller enters a skip cycle mode and provides excellent efficiency at light loads. This would be a requirement when dimming occurs at the bulb lever by the user. The driver design also provides efficient protective circuitry for over voltage and current conditions.

In light the mixing cavity 80, some of the emitted light and/or excited light from the plurality of semiconductor light emitters 30, 40 is directly forward propagated into the light mixing cavity 80. Some of the emitted light and/or excited light from the plurality of semiconductor light emitters 30, 40 is randomly redirected by the light redirection member 150 into the light mixing cavity 80 and thoroughly mixed with the directly forward propagated light from the other semiconductor light emitters 30, 40.

In another embodiment, a light redirection member 150 can be positioned within the light mixing cavity 80. The light redirection member 150 can be centered on the center axis of the light bulb housing body 20. Optionally, the light redirection member 150 can have a convex shape and can be a diffusive reflector.

In another embodiment according to the present invention, a first group of semiconductor light emitters 30 produce a blue light. A first luminescent yellow phosphor layer 60 is deposited on top of the first group of semiconductor light emitters 30 to absorb a portion of the blue light and excite a yellow light. A second luminescent green phosphor layer 70 can be disposed on top of the first luminescent layer 60 to cover at least a portion of the first luminescent layer 60, which absorbs leaked blue light from the first luminescent layer 60, excites a green light to compensate for the shortage of bluish green spectrum in the excited yellow light and excites a reddish orange light to compensate for the shortage of red spectrum in the excited yellow light. The leaked blue light, the excited yellow light, the excited reddish orange light and the excited green light are thoroughly mixed in the light mixing cavity 80. The mixture light from the diffusive output window 90 produces a warm white light with a color rendering index of at least 85 and a luminous efficacy of at least 80 lumens per watt.

In another embodiment, the second luminescent material 70 can comprise a nano-particle loaded resin which is mixed with the particles that comprise the second luminescent material 70. The refractive indexes of the nano-particle loaded resin and the particles that comprise the second luminescent material are approximately equal to one another. As a result, the back scattering of light from the second luminescent material 70 is greatly reduced by having a closely matched refractive index between the nano-particle loaded resin and the particles that comprise the second luminescent material.

Figure 2:
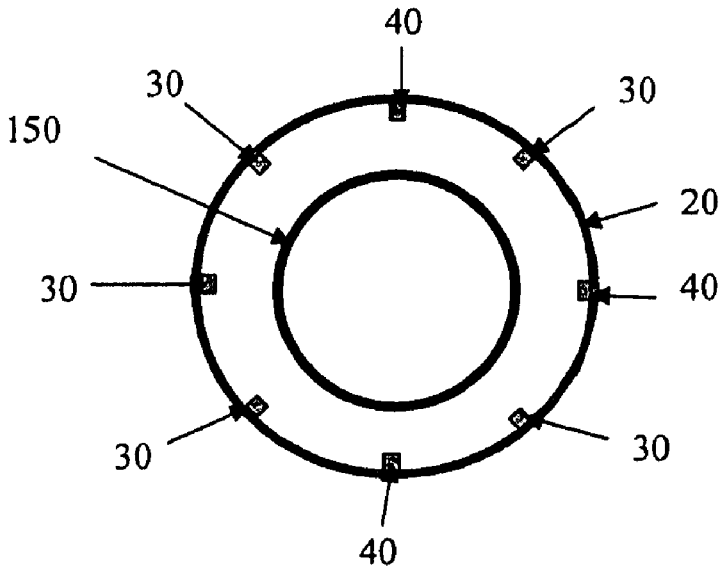
FIG. 2 is a top view of one embodiment of a light mixing cavity according to the present invention.

As shown in FIG. 2, each light emitter of the plurality of semiconductor light emitters 30, 40 is arranged to emit light rays radially inward toward the light redirection member 150. The light emitters of the plurality of semiconductor light emitters 30, 40 can be circumferentially spaced apart from one another about a periphery of said interior annular sidewall 50. Whereby, light emitted by the first group of semiconductor light emitters 30 and the second group of semiconductor light emitters 40 is reflected from the light redirection member 150 and from the reflective surfaces 86 of the light mixing cavity 80 prior to exiting the light mixing cavity 80 through the diffusive output window 90 so that light colors are thoroughly mixed. Optionally, each group of the plurality of semiconductor light emitters 30, 40 can be multi-spectrums intervallically and can be equidistantly spaced apart from one another about a periphery of the annular sidewall 50.

Figure 3:
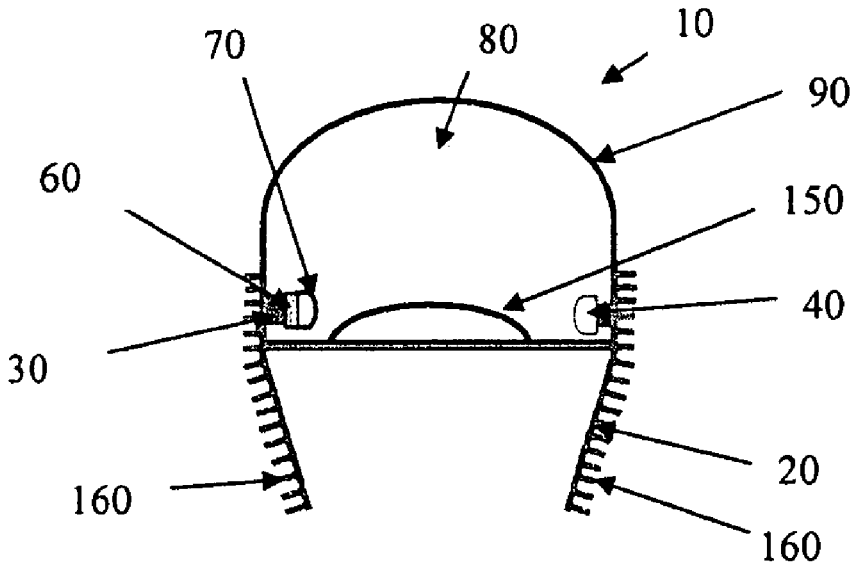
FIG. 3 is a cross sectional view of one embodiment of an LED-based light bulb according to the present invention.

As shown in FIG. 3, the LED-based light bulb 10 of the present invention has a plurality of fins 160 at an exterior surface of the light bulb thermal conductive housing body 20. The plurality of semiconductor light emitters 30, 40 are mounted around the interior sidewall 50 of the housing body 20 and against the exterior plurality of fins 160. A very short thermal dissipation path is formed for effective heat dissipation from the plurality of semiconductor light emitters 30, 40 to the thin light bulb housing 20 wall 50, to the plurality of fins 160 and to the air. The heat generated from the plurality of semiconductor light emitters 30, 40 is directly transferred onto the plurality of fins 160 through the sidewall 50 of the housing body 20 and dissipates into the air.

Figure 4:
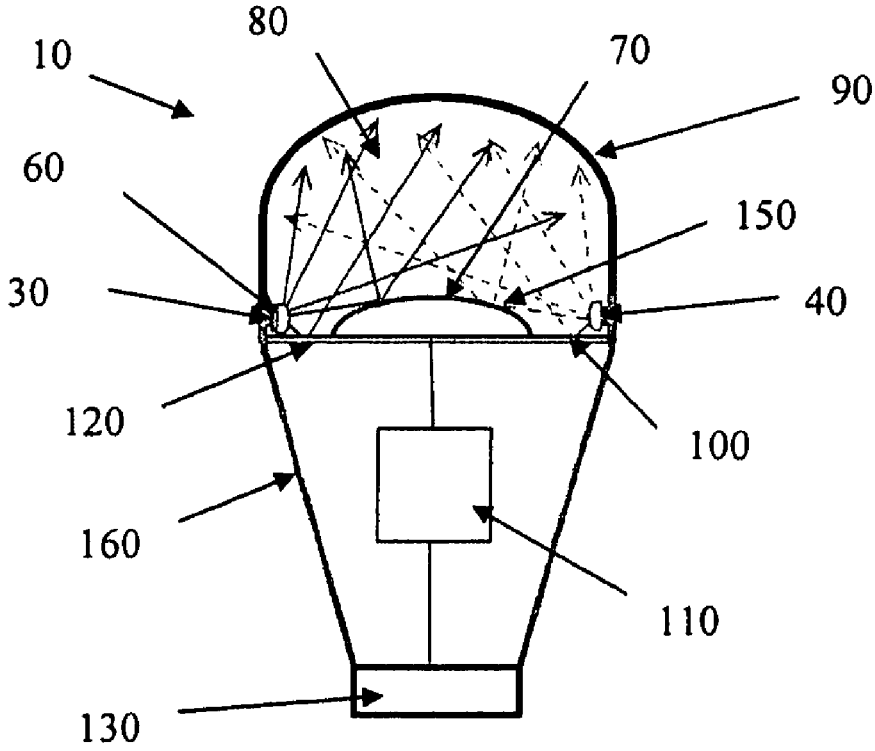
FIG. 4 is a cross sectional view of one embodiment of an LED-based light bulb according to the present invention.

As shown in FIG. 4, the LED-based light bulb 10 of the present invention comprising a plurality of semiconductor light devices that can be mounted radially around the interior annular side wall 50 of the light bulb's thermal conductive body 20 inside a light mixing cavity 80. The plurality of semiconductor light devices includes two groups of semiconductor light emitters that emit four different hues of light and a first luminescent material 60. The first group of semiconductor light emitters 30 produce a mixture of white light from an emitted primary hue of light and an excited second long wavelength hue of light. The second group of semiconductor light emitters 40 produce an emitted fourth hue of light in the red spectrum range.

The LED-based light bulb 10 of the present invention further includes a single power line 120 connected to the plurality of semiconductor light emitters 30, 40 and a high efficiency electrical AC/DC conversion and control device 110 outside of the light mixing cavity 80. The LED-based light bulb 10 of the present invention further includes a conventional Edison-mount socket 130 connecting to an AC power base (not shown). Note, the present invention is designed to integrate with a conventional Edison-mount screw-type light bulb socket, a conventional fluorescent tube coupler arrangement and a conventional halogen MR-16 socket arrangement.

The light mixing cavity 80 is positioned inside an upper portion 84 of the incandescent bulb's thermal conductive body 20. The light mixing cavity 80 comprises a diffusive light output window 90. In addition, interior wall 50 of the light mixing cavity 80 has a plurality of reflective surfaces 86 surrounding the plurality of semiconductor light emitters 30, 40. A reflective member 100 is positioned within the light mixing cavity 80. The reflective member 100 can have a convex shape in the center and is disposed under and in proximity to the plurality of semiconductor light emitters 30, 40 to redirect emission light and excitation light from the plurality of semiconductor light emitters 30, 40.

A light redirection member 150 can be positioned within the light mixing cavity 80. The light redirection member 150 can be centered on the center axis of the light bulb housing body 20. Optionally, the light redirection member 150 can have a convex shape and can be a diffusive reflector. In addition, the second luminescent layer 70 can be disposed on top of the light redirection member 150 inside the light mixing cavity 80.

Figure 5:
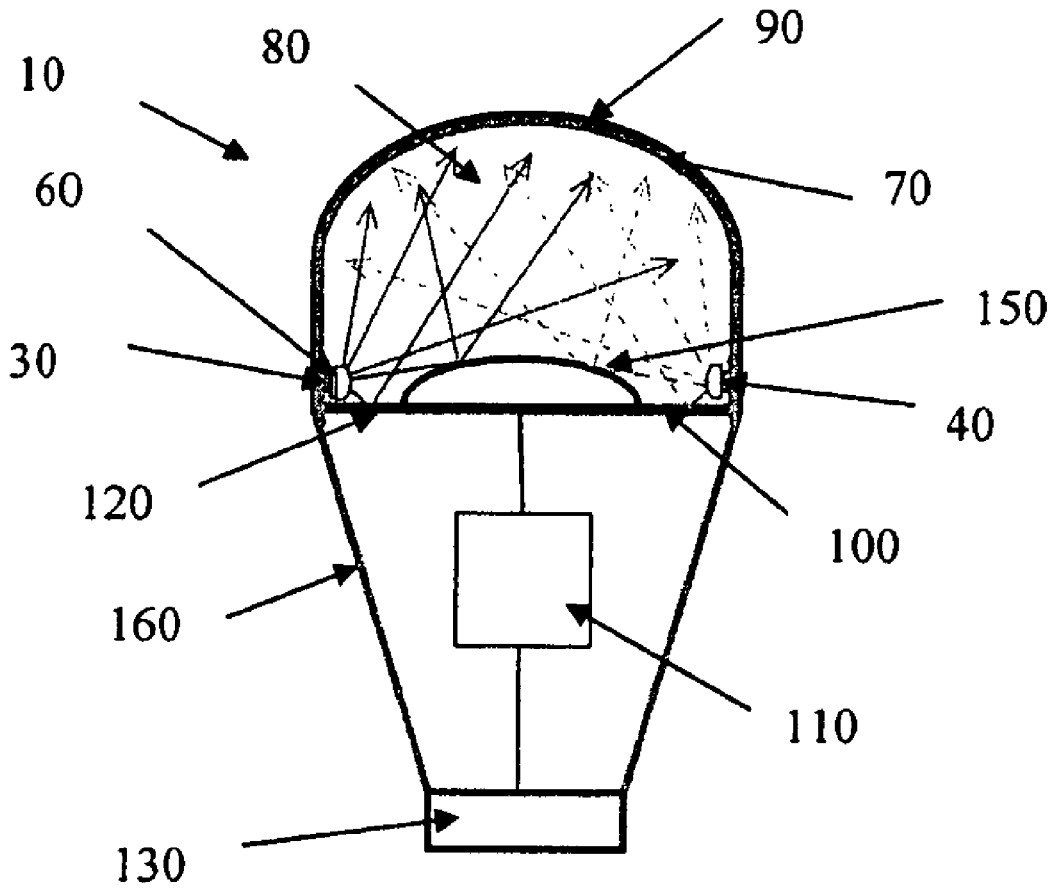
FIG. 5 is a cross sectional view of one embodiment of an LED-based light bulb according to the present invention.

As shown in FIG. 5, the LED-based light bulb 10 of the present invention comprising a plurality of semiconductor light devices that can be mounted radially around the interior annular side wall 50 of the light bulb's thermal conductive body 20 inside a light mixing cavity 80. The plurality of semiconductor light devices includes two groups of semiconductor light emitters that emit four different hues of light and a first luminescent material 60. The first group of semiconductor light emitters 30 produce a mixture of white light from an emitted primary hue of light and an excited second long wavelength hue of light. The second group of semiconductor light emitters 40 produce an emitted fourth hue of light in the red spectrum range.

The LED-based light bulb 10 of the present invention further includes a single power line 120 connected to the plurality of semiconductor light emitters 30, 40 and a high efficiency electrical AC/DC conversion and control device 110 outside of the light mixing cavity 80. The LED-based light bulb 10 of the present invention further includes a conventional Edison-mount socket 130 connecting to an AC power base (not shown). Note, the present invention is designed to integrate with a conventional Edison-mount screw-type light bulb socket, a conventional fluorescent tube coupler arrangement and a conventional halogen MR-16 socket arrangement.

The light mixing cavity 80 is positioned inside an upper portion 84 of the incandescent bulb's thermal conductive body 20. The light mixing cavity 80 comprises a diffusive light output window 90. In addition, interior wall 50 of the light mixing cavity 80 has a plurality of reflective surfaces 86 surrounding the plurality of semiconductor light emitters 30, 40. A reflective member 100 is positioned within the light mixing cavity 80. The reflective member 100 can have a convex shape in the center and is disposed under and in proximity to the plurality of semiconductor light emitters 30, 40 to redirect emission light and excitation light from the plurality of semiconductor light emitters 30, 40.

A light redirection member 150 can be positioned within the light mixing cavity 80. The light redirection member 150 can be centered on the center axis of the light bulb housing body 20. Optionally, the light redirection member 150 can have a convex shape and can be a diffusive reflector. In addition, the second luminescent layer 70 can be disposed on the interior surface of diffusive window 90.

It is understood that the above description is intended to be illustrative and not restrictive. Although various characteristics and advantages of certain embodiments of the present invention have been highlighted herein, many other embodiments will be apparent to those skilled in the art without deviating from the scope and spirit of the invention disclosed. The scope of the invention should therefore be determined with reference to the claims contained herewith as well as the full scope of equivalents to which said claims are entitled.

Now that the invention has been described,

What is claimed is:

1. An LED-based light bulb, comprising:

a thermal conductive light bulb housing body;

a first group of semiconductor light emitters mounted radially around an interior annular sidewall of said thermal conductive light bulb housing body;

a second group of semiconductor light emitters mounted radially around said interior annular sidewall of said thermal conductive light bulb housing body;

a first luminescent material disposed on top of said first group of semiconductor light emitters;

said first group of semiconductor light emitters and said second group of semiconductor light emitters emitting at least four different hues of light;

a light mixing cavity inside an upper portion of said thermal conductive light bulb housing body, said light mixing cavity having a plurality of reflective surfaces and a diffusive light output window;

a reflective member positioned within said light mixing cavity and positioned under said first group of semiconductor light emitters and said second group of semiconductor light emitters;

an electrical AC-to-DC converting device disposed external to said light mixing cavity inside a bottom portion of said thermal conductive light bulb housing body, said electrical AC-to-DC converting device being in electrical communication with each light emitter of said first group of semiconductor light emitters and said second group of semiconductor light emitters; and at least one power connection having a form to engage mechanically and electrically with one of a conventional Edison-mount screw-type light bulb socket, a conventional fluorescent tube coupler arrangement, and a conventional halogen MR-16 socket arrangement, said power connection being in electrical communication to said electrical AC-to-DC converting device.

2. The LED-based light bulb according to claim 1, further comprising:

said first group of semiconductor light emitters emitting a blue light;

said first luminescent material absorbing at least a portion of said blue light and exciting a yellow light; and a second luminescent material covering at least a portion of said first luminescent material, said second luminescent material absorbing leaked blue light from said first luminescent material and exciting a green light;

whereby the combination of leaked blue light, excited yellow light and excited green light produce a greenish yellow light.

3. The LED-based light bulb according to claim 2, wherein said greenish yellow light having x, y chromaticity coordinates on 1931 CIE Chromaticity Diagram within an area enclosed by four line segments having (x, y) coordinates (0.31, 0.41), (0.29, 0.51), (0.39, 0.47), and (0.38, 0.40).

4. The LED-based light bulb according to claim 2, further comprising a transparent resin layer between said first luminescent material and said second luminescent material.

5. The LED-based light bulb according to claim 4, wherein said transparent resin layer further comprising a dome shape.

6. The LED-based light bulb according to claim 1, wherein said second group of semiconductor light emitters emitting a reddish orange light.

7. The LED-based light bulb according to claim 1, further comprising:

each light emitter of said first group of semiconductor light emitters and said second group of semiconductor light emitters being circumferentially spaced apart from one another about a periphery of said interior annular sidewall of said thermal conductive light bulb housing body; and each light emitter of said first group of semiconductor light emitters and said second group of semiconductor light emitters being multi-spectrums intervallically and equidistantly spaced apart from one another about a periphery of said annular sidewall of said thermal conductive light bulb housing body.

8. The LED-based light bulb according to claim 1, wherein said electrical AC-to-DC converting device further comprising:

a high power factor; and a single chip based controller in a close loop Pulse Width Current Modulator; said single chip driving a single high side Field Effect Transistor.

9. The LED-based light bulb according to claim 1, further comprising:

said light bulb thermal conductive housing body having a plurality of fins at an exterior surface; and said first group of semiconductor light emitters and said second group of semiconductor light emitters being mounted against said plurality of fins;

whereby the heat generated from said first group of semiconductor light emitters and said second group of semiconductor light emitters directly transfers onto said plurality of fins through said sidewall of said housing body and dissipates into the air.

10. The LED-based light bulb according to claim 1, further comprising:

a light redirection member positioned within said light mixing cavity, said light redirection member being centered on the center axis of said light bulb housing body; and each light emitter of said first group of semiconductor light emitters and said second group of semiconductor light emitters being arranged to emit light rays radially inwardly toward said light redirection member;

whereby light emitted by said first group of semiconductor light emitters and said second group of semiconductor light emitters is reflected from said light redirection member and from said reflective surfaces of said light mixing cavity prior to exiting said light mixing cavity through said diffusive light output window so that light colors are thoroughly mixed.

11. The LED-based light bulb according to claim 10, wherein said light redirection member further comprising a convex shape.

12. The LED-based light bulb according to claim 10, wherein said light redirection member being a diffusive reflector.

13. The LED-based light bulb according to claim 10, further comprising:

said first group of semiconductor light emitters emitting a blue light;

said first luminescent material absorbing at least a portion of said blue light and exciting a yellow light;

at least a portion of said blue light being leaked from said first luminescent material;

said second group of semiconductor light emitters emitting a reddish orange light; and a second luminescent layer being disposed on top of said light redirection member inside said light mixing cavity, said second luminescent layer absorbing leaked blue light from said first luminescent layer and exciting a green light;

whereby the combination of the leaked blue light, the excited yellow light, the emitted reddish orange light and the excited green light produce a warm white light with a color rendering index of at least 85 and a luminous efficacy of at least 80 lumens per watt.

14. The LED-based light bulb according to claim 13, wherein said second luminescent layer being further disposed on an interior surface of said diffusive light window of said light mixing cavity.

15. The LED-based light bulb according to claim 14, wherein said second luminescent layer further comprising a blue absorption filter; said blue absorption filter absorbing at least a portion of leaked blue light from said first luminescent layer and passing through light having a wavelength longer than 500 nm.

16. An LED-based light bulb, comprising:

a thermal conductive light bulb housing body;

a first group of semiconductor light emitters mounted radially around an interior annular sidewall of said thermal conductive light bulb housing body, said first group of semiconductor light emitters emitting a blue light;

a first luminescent material disposed on top of said first group of semiconductor light emitters, said first luminescent material absorbing at least a portion of said blue light and exciting a yellow light;

a second luminescent material covering at least a portion of said first luminescent material, said second luminescent material absorbing leaked blue light from said first luminescent material and exciting a green light and a reddish orange light;

a light mixing cavity inside an upper portion of said thermal conductive light bulb housing body, said light mixing cavity having a plurality of reflective surfaces and a diffusive light output window;

a reflective member positioned within said light mixing cavity and positioned under said first group of semiconductor light emitters;

an electrical AC-to-DC converting device disposed external to said light mixing cavity inside a bottom portion of said thermal conductive light bulb housing body, said electrical AC-to-DC converting device being in electrical communication with each light emitter of said first group of semiconductor light emitters; and at least one power connection having a form to engage mechanically and electrically with one of a conventional Edison-mount screw-type light bulb socket, a conventional fluorescent tube coupler arrangement, and a conventional halogen MR-16 socket arrangement, said power connection being in electrical communication to said electrical AC-to-DC converting device;

whereby the combination of leaked blue light, excited yellow light, excited reddish orange light and excited green light produce a warm white light.

17. The LED-based light bulb according to claim 16, further comprising a transparent resin layer between said first luminescent material and said second luminescent material.

18. The LED-based light bulb according to claim 17, wherein said transparent resin layer further comprising a dome shape.

19. The LED-based light bulb according to claim 16, wherein said second luminescent material further comprising a nano-particle loaded resin having a first refractive index and second luminescent particles having a second refractive index, said first refractive index being approximately equal to said second refractive index.

20. An LED-based light bulb, comprising:

a thermal conductive light bulb housing body;

a first group of semiconductor light emitters mounted radially around an interior annular sidewall of said thermal conductive light bulb housing body;

a second group of semiconductor light emitters mounted radially around said interior annular sidewall of said thermal conductive light bulb housing body;

each light emitter of said first group of semiconductor light emitters and said second group of semiconductor light emitters being circumferentially spaced apart from one another about a periphery of said interior annular sidewall of said thermal conductive light bulb housing body;

each light emitter of said first group of semiconductor light emitters and said second group of semiconductor light emitters being multi-spectrums intervallically and equidistantly spaced apart from one another about a periphery of said annular sidewall of said thermal conductive light bulb housing body;

a first luminescent material disposed on top of said first group of semiconductor light emitters;

said first group of semiconductor light emitters and said second group of semiconductor light emitters emitting at least four different hues of light;

a light mixing cavity inside an upper portion of said thermal conductive light bulb housing body, said light mixing cavity having a plurality of reflective surfaces and a diffusive light output window;

a reflective member positioned within said light mixing cavity and positioned under said first group of semiconductor light emitters and said second group of semiconductor light emitters;

an electrical AC-to-DC converting device disposed external to said light mixing cavity inside a bottom portion of said thermal conductive light bulb housing body, said electrical AC-to-DC converting device being in electrical communication with each light emitter of said first group of semiconductor light emitters and said second group of semiconductor light emitters;

at least one power connection having a form to engage mechanically and electrically with one of a conventional Edison-mount screw-type light bulb socket, a conventional fluorescent tube coupler arrangement, and a conventional halogen MR-16 socket arrangement, said power connection being in electrical communication to said electrical AC-to-DC converting device;

a light redirection member positioned within said light mixing cavity, said light redirection member being centered on the center axis of said light bulb housing body; and each light emitter of said first group of semiconductor light emitters and said second group of semiconductor light emitters being arranged to emit light rays radially inwardly toward said light redirection member;

whereby light emitted by said first group of semiconductor light emitters and said second group of semiconductor light emitters is reflected from said light redirection member and from said reflective surfaces of said light mixing cavity prior to exiting said light mixing cavity through said diffusive light output window so that light colors are thoroughly mixed into a warm white color.

21. The LED-based light bulb according to claim 20, further comprising:

said first group of semiconductor light emitters emitting a blue light;

said first luminescent material absorbing at least a portion of said blue light and exciting a yellow light; and a second luminescent material covering at least a portion of said first luminescent material, said second luminescent material absorbing leaked blue light from said first luminescent material and exciting a green light;

whereby the combination of leaked blue light, excited yellow light and excited green light produce a greenish yellow light.

22. The LED-based light bulb according to claim 20, wherein said second group of semiconductor light emitters emitting a reddish orange light.

23. The LED-based light bulb according to claim 20, wherein said light redirection member further comprising a convex shape.

24. The LED-based light bulb according to claim 20, wherein said light redirection member being a diffusive reflector.

* * * * *